US010801278B2

(12) United States Patent
Zheng et al.

(10) Patent No.: US 10,801,278 B2
(45) Date of Patent: Oct. 13, 2020

(54) INSTRUMENTED DRILLING RIG SLIPS

(71) Applicant: Schlumberger Technology Corporation, Sugar Land, TX (US)

(72) Inventors: Shunfeng Zheng, Katy, TX (US); Jacques Orban, Katy, TX (US); Vishwanathan Parmeshwar, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 438 days.

(21) Appl. No.: 14/970,071

(22) Filed: Dec. 15, 2015

(65) Prior Publication Data

US 2016/0290073 A1 Oct. 6, 2016

Related U.S. Application Data

(60) Provisional application No. 62/140,701, filed on Mar. 31, 2015.

(51) Int. Cl.
*E21B 19/10* (2006.01)
*E21B 44/00* (2006.01)
*E21B 47/00* (2012.01)

(52) U.S. Cl.
CPC ..... *E21B 19/10* (2013.01); *E21B 44/00* (2013.01); *E21B 47/00* (2013.01)

(58) Field of Classification Search
CPC ..... E21B 19/10; E21B 44/00; E21B 47/00
See application file for complete search history.

(56) References Cited

U.S. PATENT DOCUMENTS 4,715,456 A * 12/1987 Poe, Jr. ..... E21B 19/10 175/423
6,264,395 B1 * 7/2001 Allamon ..... E21B 19/10 285/123.5
8,727,021 B2 * 5/2014 Heidecke ..... E21B 3/02 166/380
8,752,619 B2 6/2014 Mulder et al.
2002/0170720 A1 * 11/2002 Haugen ..... E21B 19/00 166/379
2005/0167094 A1 * 8/2005 Streich ..... E21B 33/12 166/66
2005/0260040 A1 * 11/2005 Ingle ..... E02B 17/021 405/198
2006/0124353 A1 * 6/2006 Juhasz ..... E21B 19/07 175/40
2008/0264648 A1 10/2008 Pietras et al.
2010/0101805 A1 * 4/2010 Angelle ..... E21B 19/07 166/380
2011/0048737 A1 3/2011 Schneider
2012/0043071 A1 2/2012 Matherne, Jr. et al.
2012/0152530 A1 * 6/2012 Wiedecke ..... E21B 19/07 166/250.01

(Continued)

*Primary Examiner* — Benjamin F Fiorello
(74) *Attorney, Agent, or Firm* — Rachel E. Greene

(57) ABSTRACT

A slips assembly for a drilling rig and methods. The slips assembly includes a body, a plurality of slips disposed within the body and configured to extend radially inward to engage a tubular, and to retract radially outward to form a gap between the tubular and the plurality of slips, and sensors configured to detect a force on the plurality of slips generated by the plurality of slips engaging the tubular.

26 Claims, 12 Drawing Sheets

(56) References Cited

U.S. PATENT DOCUMENTS

| | | | | |
|---|---|---|---|---|
| 2012/0160518 | A1* | 6/2012 | Sonnier | E21B 19/08 166/382 |
| 2012/0325496 | A1* | 12/2012 | Angelle | E21B 19/07 166/380 |
| 2013/0112479 | A1 | 5/2013 | O'Blenes | |
| 2013/0220637 | A1* | 8/2013 | Fabela | E21B 19/10 166/382 |
| 2014/0158374 | A1 | 6/2014 | Angelle et al. | |
| 2015/0152698 | A1* | 6/2015 | DeBerry | E21B 17/046 166/344 |
| 2015/0167446 | A1* | 6/2015 | Taskinen | E21B 47/00 166/382 |
| 2017/0241217 | A1* | 8/2017 | Holen | E21B 19/16 |

* cited by examiner

INSTRUMENTED DRILLING RIG SLIPS

CROSS-REFERENCE TO RELATED APPLICATIONS

This application claims priority to U.S. Provisional Patent Application having Ser. No. 62/140,701, which was filed on Mar. 31, 2015 and is incorporated herein by reference in its entirety.

BACKGROUND

On a drilling rig, two devices are generally provided that are capable of supporting the weight of a string of drill pipe that extends into the wellbore during the drilling process. The first device is movable, such as a top drive, and may serve to lower the drill string into the wellbore as the drill string is rotated, thereby allowing the drill bit to advance in the earth. The second device is generally a slips assembly, which may include retractable slips. The slips may include gripping structures with wickers or teeth that bite into the drill pipe, to support the drill string. The slips assembly is disposed at or proximal to the rig floor, generally below the first device. The slips are provided to hold the drill string after lowering each segment of drill pipe, while a new segment of drill pipe is attached to the first device and then attached to the string of drill pipe. Once the connection between the first device, the new drill pipe segment, and the drill string is made, the slips assembly releases the drill pipe and the weight of the drill string is once again supported by the first device.

The slips assembly presents a risk of dropping the tubular if the slips do not adequately engage the tubular. Accordingly, safety measures are implemented in order to mitigate the risk of slipping. Such safety measures may include a safety clamp fixed to the drill pipe in the case of "slick" pipe that has a minimal upset.

The handoff between the first device (e.g., top drive) and the second device (e.g., slips assembly) presents challenges. Among those is determining with certainty that the slips are set (i.e., the drill string is "in-slip") and can carry the full weight of the drill string, determining when the slips assembly has released the drill string, and determining when the slips assembly may be allowing the drill string to move vertically, despite nominally being in-slip.

Generally, these determinations are done by visual inspection by an operator on the rig. However, it may be difficult to determine if the slips assembly is allowing the drill string to move based solely on visual inspection. Such movement ("slipping") may be indicative of a fail slip mechanism. When the drill string is in slips, it may be difficult to determine if the weight of the drill string carried by the slips is changed. Such a change in weight carried by slips may be indicative of abnormal well conditions, such as a pressure fluctuation or "kick." Further, before the first device releases from the tubular, to avoid dropping the drill string, and to monitor the downhole pressure conditions relevant to "well kicks" or a like, which can be catastrophic, the operator may desire to know for certain that the slips are set, and well pressure is stable, and visual inspection may be unreliable, subject to human error, and may expose operators to safety issues on the drill floor environment.

SUMMARY

Embodiments of the present disclosure may provide a slips assembly for a drilling rig. The slips assembly includes a body, a plurality of slips disposed within the body and configured to extend radially inward to engage a tubular, and to retract radially outward to form a gap between the tubular and the plurality of slips, and sensors configured to detect a force on the plurality of slips generated by the plurality of slips engaging the tubular.

Embodiments of the disclosure may also provide a method for supporting a tubular. The method includes lowering a tubular through a slips assembly using a first device, measuring a hookload while the first device supports the tubular, engaging the tubular using the slips assembly, measuring a force incident on one or more slips of the slips assembly while the slips assembly is engaging the tubular, determining a slips load on the slips assembly based on the force that is measured, comparing the slips load to the hookload, and determining whether the tubular is supported by the slips assembly based on the comparison of the slips load to the hookload.

Embodiments of the disclosure may further provide a method for monitoring a well condition. The method includes supporting a tubular using a slips assembly, and measuring a force on the slips assembly. The force varies based on a weight of the tubular that is supported by the slips assembly. The method also includes detecting a fluctuation in the weight supported by the slips assembly, while the slips assembly is supporting the tubular, and taking a corrective action in response to detecting the fluctuation.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to specific embodiments illustrated in the accompanying drawings and figures. In the following detailed description, numerous specific details are set forth in order to provide a thorough understanding of the invention. However, it will be apparent to one of ordinary skill in the art that embodiments may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object or step, and, similarly, a second object could be termed a first object or step, without departing from the scope of the present disclosure.

The terminology used in the description of the invention herein is for the purpose of describing particular embodiments only and is not intended to be limiting. As used in the description of the invention and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Figure 1:
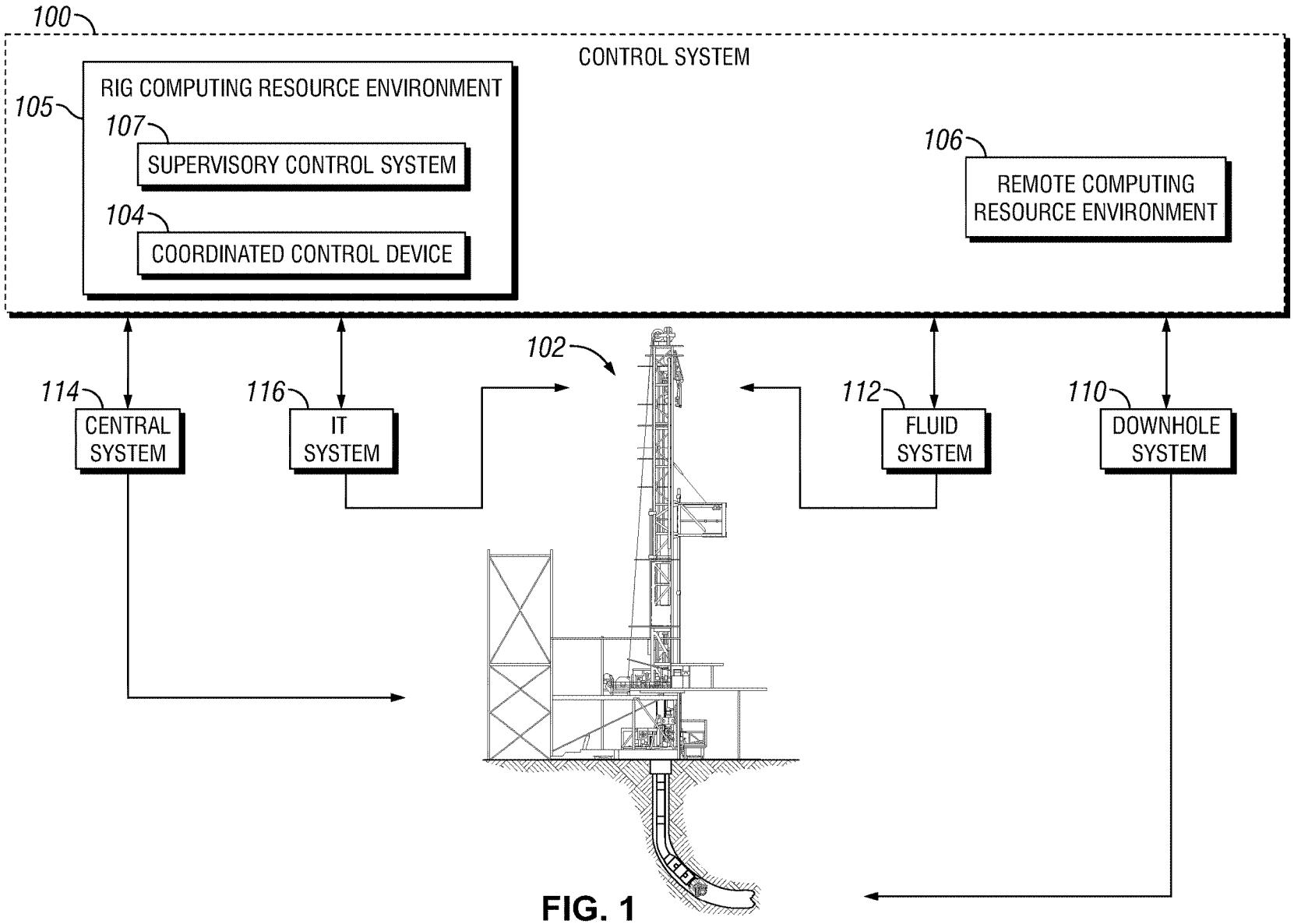
FIG. 1 illustrates a schematic view of a drilling rig and a control system, according to an embodiment.

FIG. 1 illustrates a conceptual, schematic view of a control system 100 for a drilling rig 102, according to an embodiment. The control system 100 may include a rig computing resource environment 105, which may be located onsite at the drilling rig 102 and, in some embodiments, may have a coordinated control device 104. The control system 100 may also provide a supervisory control system 107. In some embodiments, the control system 100 may include a remote computing resource environment 106, which may be located offsite from the drilling rig 102.

The remote computing resource environment 106 may include computing resources locating offsite from the drilling rig 102 and accessible over a network. A "cloud" computing environment is one example of a remote computing resource. The cloud computing environment may communicate with the rig computing resource environment 105 via a network connection (e.g., a WAN or LAN connection). In some embodiments, the remote computing resource environment 106 may be at least partially located onsite, e.g., allowing control of various aspects of the drilling rig 102 onsite through the remote computing resource environment 105 (e.g., via mobile devices). Accordingly, "remote" should not be limited to any particular distance away from the drilling rig 102.

Further, the drilling rig 102 may include various systems with different sensors and equipment for performing operations of the drilling rig 102, and may be monitored and controlled via the control system 100, e.g., the rig computing resource environment 105. Additionally, the rig computing resource environment 105 may provide for secured access to rig data to facilitate onsite and offsite user devices monitoring the rig, sending control processes to the rig, and the like.

Various example systems of the drilling rig 102 are depicted in FIG. 1. For example, the drilling rig 102 may include a downhole system 110, a fluid system 112, and a central system 114. These systems 110, 112, 114 may also be examples of "subsystems" of the drilling rig 102, as described herein. In some embodiments, the drilling rig 102 may include an information technology (IT) system 116. The downhole system 110 may include, for example, a bottom-hole assembly (BHA), mud motors, sensors, etc. disposed along the drill string, and/or other drilling equipment configured to be deployed into the wellbore. Accordingly, the downhole system 110 may refer to tools disposed in the wellbore, e.g., as part of the drill string used to drill the well.

The fluid system 112 may include, for example, drilling mud, pumps, valves, cement, mud-loading equipment, mud-management equipment, pressure-management equipment, separators, and other fluids equipment. Accordingly, the fluid system 112 may perform fluid operations of the drilling rig 102.

The central system 114 may include a hoisting and rotating platform, top drives, rotary tables, kellys, drawworks, pumps, generators, tubular handling equipment, derricks, masts, substructures, and other suitable equipment. Accordingly, the central system 114 may perform power generation, hoisting, and rotating operations of the drilling rig 102, and serve as a support platform for drilling equipment and staging ground for rig operation, such as connection make up, etc. The IT system 116 may include software, computers, and other IT equipment for implementing IT operations of the drilling rig 102.

The control system 100, e.g., via the coordinated control device 104 of the rig computing resource environment 105, may monitor sensors from multiple systems of the drilling rig 102 and provide control commands to multiple systems of the drilling rig 102, such that sensor data from multiple systems may be used to provide control commands to the different systems of the drilling rig 102. For example, the system 100 may collect temporally and depth aligned surface data and downhole data from the drilling rig 102 and store the collected data for access onsite at the drilling rig 102 or offsite via the rig computing resource environment 105. Thus, the system 100 may provide monitoring capability. Additionally, the control system 100 may include supervisory control via the supervisory control system 107.

In some embodiments, one or more of the downhole system 110, fluid system 112, and/or central system 114 may be manufactured and/or operated by different vendors. In such an embodiment, certain systems may not be capable of unified control (e.g., due to different protocols, restrictions on control permissions, safety concerns for different control systems, etc.). An embodiment of the control system 100 that is unified, may, however, provide control over the drilling rig 102 and its related systems (e.g., the downhole system 110, fluid system 112, and/or central system 114, etc.). Further, the downhole system 110 may include one or a plurality of downhole systems. Likewise, fluid system 112, and central system 114 may contain one or a plurality of fluid systems and central systems, respectively.

In addition, the coordinated control device 104 may interact with the user device(s) (e.g., human-machine interface(s)) 118, 120. For example, the coordinated control device 104 may receive commands from the user devices 118, 120 and may execute the commands using two or more of the rig systems 110, 112, 114, e.g., such that the operation of the two or more rig systems 110, 112, 114 act in concert and/or off-design conditions in the rig systems 110, 112, 114 may be avoided.

Figure 2:
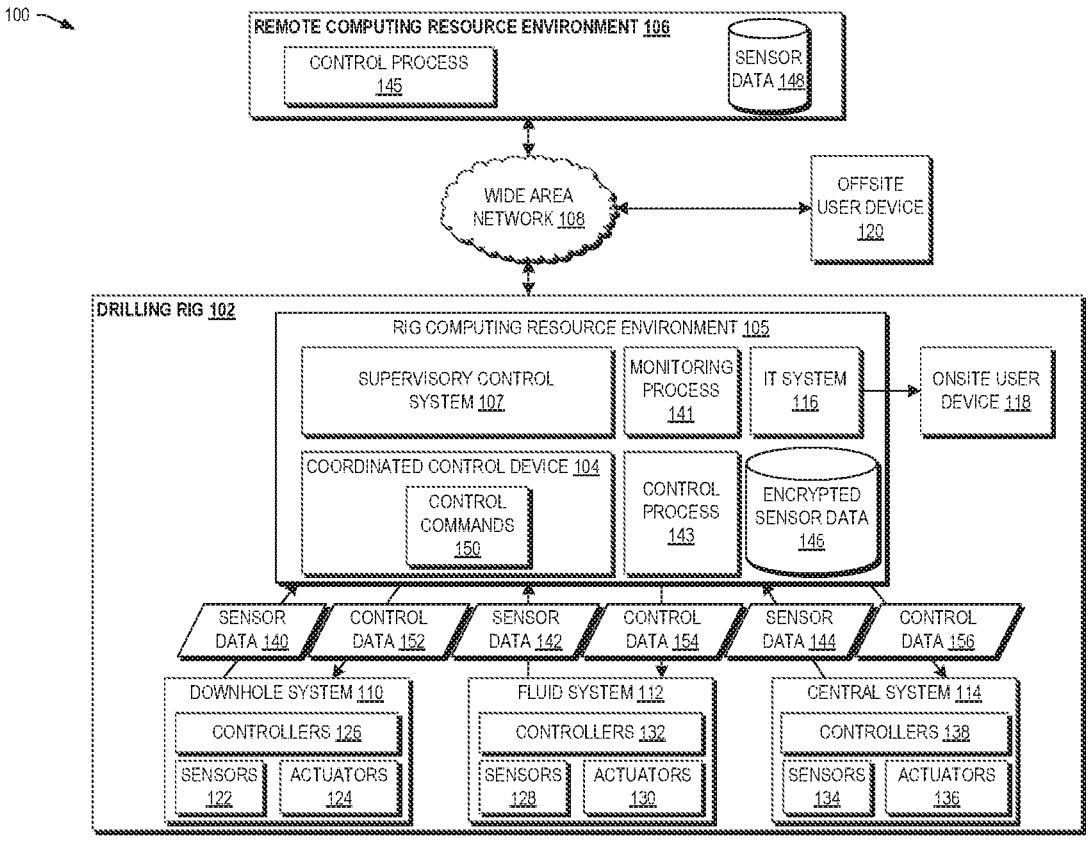
FIG. 2 illustrates a schematic view of a drilling rig and a remote computing resource environment, according to an embodiment.

FIG. 2 illustrates a conceptual, schematic view of the control system 100, according to an embodiment. The rig computing resource environment 105 may communicate with offsite devices and systems using a network 108 (e.g., a wide area network (WAN) such as the internet). Further, the rig computing resource environment 105 may communicate with the remote computing resource environment 106 via the network 108. FIG. 2 also depicts the aforementioned example systems of the drilling rig 102, such as the downhole system 110, the fluid system 112, the central system 114, and the IT system 116. In some embodiments, one or more onsite user devices 118 may also be included on the drilling rig 102. The onsite user devices 118 may interact with the IT system 116. The onsite user devices 118 may include any number of user devices, for example, stationary user devices intended to be stationed at the drilling rig 102 and/or portable user devices. In some embodiments, the onsite user devices 118 may include a desktop, a laptop, a smartphone, a personal data assistant (PDA), a tablet component, a wearable computer, or other suitable devices. In some embodiments, the onsite user devices 118 may communicate with the rig computing resource environment 105 of the drilling rig 102, the remote computing resource environment 106, or both.

One or more offsite user devices 120 may also be included in the system 100. The offsite user devices 120 may include a desktop, a laptop, a smartphone, a personal data assistant (PDA), a tablet component, a wearable computer, or other suitable devices. The offsite user devices 120 may be configured to receive and/or transmit information (e.g., monitoring functionality) from and/or to the drilling rig 102 via communication with the rig computing resource environment 105. In some embodiments, the offsite user devices 120 may provide control processes for controlling operation of the various systems of the drilling rig 102. In some embodiments, the offsite user devices 120 may communicate with the remote computing resource environment 106 via the network 108.

The user devices 118 and/or 120 may be examples of a human-machine interface. These devices 118, 120 may allow feedback from the various rig subsystems to be displayed and allow commands to be entered by the user. In various embodiments, such human-machine interfaces may be onsite or offsite, or both.

The systems of the drilling rig 102 may include various sensors, actuators, and controllers (e.g., programmable logic controllers (PLCs)), which may provide feedback for use in the rig computing resource environment 105. For example, the downhole system 110 may include sensors 122, actuators 124, and controllers 126. The fluid system 112 may include sensors 128, actuators 130, and controllers 132. Additionally, the central system 114 may include sensors 134, actuators 136, and controllers 138. The sensors 122, 128, and 134 may include any suitable sensors for operation of the drilling rig 102. In some embodiments, the sensors 122, 128, and 134 may include a camera, a pressure sensor, a temperature sensor, a flow rate sensor, a vibration sensor, a current sensor, a voltage sensor, a resistance sensor, a gesture detection sensor or device, a voice actuated or recognition device or sensor, or other suitable sensors.

The sensors described above may provide sensor data feedback to the rig computing resource environment 105 (e.g., to the coordinated control device 104). For example, downhole system sensors 122 may provide sensor data 140, the fluid system sensors 128 may provide sensor data 142, and the central system sensors 134 may provide sensor data 144. The sensor data 140, 142, and 144 may include, for example, equipment operation status (e.g., on or off, up or down, set or release, etc.), drilling parameters (e.g., depth, hook load, torque, etc.), auxiliary parameters (e.g., vibration data of a pump) and other suitable data. In some embodiments, the acquired sensor data may include or be associated with a timestamp (e.g., a date, time or both) indicating when the sensor data was acquired. Further, the sensor data may be aligned with a depth or other drilling parameter.

Acquiring the sensor data into the coordinated control device 104 may facilitate measurement of the same physical properties at different locations of the drilling rig 102. In some embodiments, measurement of the same physical properties may be used for measurement redundancy to enable continued operation of the well. In yet another embodiment, measurements of the same physical properties at different locations may be used for detecting equipment conditions among different physical locations. In yet another embodiment, measurements of the same physical properties using different sensors may provide information about the relative quality of each measurement, resulting in a "higher" quality measurement being used for rig control, and process applications. The variation in measurements at different locations over time may be used to determine equipment performance, system performance, scheduled maintenance due dates, and the like. Furthermore, aggregating sensor data from each subsystem into a centralized environment may enhance drilling process and efficiency. For example, slip status (e.g., in or out) may be acquired from the sensors and provided to the rig computing resource environment 105, which may be used to define a rig state for automated control. In another example, acquisition of fluid samples may be measured by a sensor and related with bit depth and time measured by other sensors. Acquisition of data from a camera sensor may facilitate detection of arrival and/or installation of materials or equipment in the drilling rig 102. The time of arrival and/or installation of materials or equipment may be used to evaluate degradation of a material, scheduled maintenance of equipment, and other evaluations.

The coordinated control device 104 may facilitate control of individual systems (e.g., the central system 114, the downhole system, or fluid system 112, etc.) at the level of each individual system. For example, in the fluid system 112, sensor data 128 may be fed into the controller 132, which may respond to control the actuators 130. However, for control operations that involve multiple systems, the control may be coordinated through the coordinated control device 104. Examples of such coordinated control operations include the control of downhole pressure during tripping. The downhole pressure may be affected by both the fluid system 112 (e.g., pump rate and choke position) and the central system 114 (e.g. tripping speed). When it is desired to maintain certain downhole pressure during tripping, the coordinated control device 104 may be used to direct the appropriate control commands. Furthermore, for mode based controllers which employ complex computation to reach a control setpoint, which are typically not implemented in the subsystem PLC controllers due to complexity and high computing power demands, the coordinated control device 104 may provide the adequate computing environment for implementing these controllers.

In some embodiments, control of the various systems of the drilling rig 102 may be provided via a multi-tier (e.g., three-tier) control system that includes a first tier of the controllers 126, 132, and 138, a second tier of the coordinated control device 104, and a third tier of the supervisory control system 107. The first tier of the controllers may be responsible for safety critical control operation, or fast loop feedback control. The second tier of the controllers may be responsible for coordinated controls of multiple equipment or subsystems, and/or responsible for complex model based controllers. The third tier of the controllers may be responsible for high level task planning, such as to command the rig system to maintain certain bottom hole pressure. In other embodiments, coordinated control may be provided by one or more controllers of one or more of the drilling rig systems 110, 112, and 114 without the use of a coordinated control device 104. In such embodiments, the rig computing resource environment 105 may provide control processes directly to these controllers for coordinated control. For example, in some embodiments, the controllers 126 and the controllers 132 may be used for coordinated control of multiple systems of the drilling rig 102.

The sensor data 140, 142, and 144 may be received by the coordinated control device 104 and used for control of the drilling rig 102 and the drilling rig systems 110, 112, and 114. In some embodiments, the sensor data 140, 142, and 144 may be encrypted to produce encrypted sensor data 146. For example, in some embodiments, the rig computing resource environment 105 may encrypt sensor data from different types of sensors and systems to produce a set of encrypted sensor data 146. Thus, the encrypted sensor data 146 may not be viewable by unauthorized user devices (either offsite or onsite user device) if such devices gain access to one or more networks of the drilling rig 102. The sensor data 140, 142, 144 may include a timestamp and an aligned drilling parameter (e.g., depth) as discussed above. The encrypted sensor data 146 may be sent to the remote computing resource environment 106 via the network 108 and stored as encrypted sensor data 148.

The rig computing resource environment 105 may provide the encrypted sensor data 148 available for viewing and processing offsite, such as via offsite user devices 120. Access to the encrypted sensor data 148 may be restricted via access control implemented in the rig computing resource environment 105. In some embodiments, the encrypted sensor data 148 may be provided in real-time to offsite user devices 120 such that offsite personnel may view real-time status of the drilling rig 102 and provide feedback based on the real-time sensor data. For example, different portions of the encrypted sensor data 146 may be sent to offsite user devices 120. In some embodiments, encrypted sensor data may be decrypted by the rig computing resource environment 105 before transmission or decrypted on an offsite user device after encrypted sensor data is received.

The offsite user device 120 may include a client (e.g., a thin client) configured to display data received from the rig computing resource environment 105 and/or the remote computing resource environment 106. For example, multiple types of thin clients (e.g., devices with display capability and minimal processing capability) may be used for certain functions or for viewing various sensor data.

The rig computing resource environment 105 may include various computing resources used for monitoring and controlling operations such as one or more computers having a processor and a memory. For example, the coordinated control device 104 may include a computer having a processor and memory for processing sensor data, storing sensor data, and issuing control commands responsive to sensor data. As noted above, the coordinated control device 104 may control various operations of the various systems of the drilling rig 102 via analysis of sensor data from one or more drilling rig systems (e.g. 110, 112, 114) to enable coordinated control between each system of the drilling rig 102. The coordinated control device 104 may execute control commands 150 for control of the various systems of the drilling rig 102 (e.g., drilling rig systems 110, 112, 114). The coordinated control device 104 may send control data determined by the execution of the control commands 150 to one or more systems of the drilling rig 102. For example, control data 152 may be sent to the downhole system 110, control data 154 may be sent to the fluid system 112, and control data 154 may be sent to the central system 114. The control data may include, for example, operator commands (e.g., turn on or off a pump, switch on or off a valve, update a physical property setpoint, etc.). In some embodiments, the coordinated control device 104 may include a fast control loop that directly obtains sensor data 140, 142, and 144 and executes, for example, a control algorithm. In some embodiments, the coordinated control device 104 may include a slow control loop that obtains data via the rig computing resource environment 105 to generate control commands.

In some embodiments, the coordinated control device 104 may intermediate between the supervisory control system 107 and the controllers 126, 132, and 138 of the systems 110, 112, and 114. For example, in such embodiments, a supervisory control system 107 may be used to control systems of the drilling rig 102. The supervisory control system 107 may include, for example, devices for entering control commands to perform operations of systems of the drilling rig 102. In some embodiments, the coordinated control device 104 may receive commands from the supervisory control system 107, process the commands according to a rule (e.g., an algorithm based upon the laws of physics for drilling operations), and/or control processes received from the rig computing resource environment 105, and provides control data to one or more systems of the drilling rig 102. In some embodiments, the supervisory control system 107 may be provided by and/or controlled by a third party. In such embodiments, the coordinated control device 104 may coordinate control between discrete supervisory control systems and the systems 110, 112, and 114 while using control commands that may be optimized from the sensor data received from the systems 110, 112, and 114 and analyzed via the rig computing resource environment 105.

The rig computing resource environment 105 may include a monitoring process 141 that may use sensor data to determine information about the drilling rig 102. For example, in some embodiments the monitoring process 141 may determine a drilling state, equipment health, system health, a maintenance schedule, or any combination thereof. Furthermore, the monitoring process 141 may monitor sensor data and determine the quality of one or a plurality of sensor data. In some embodiments, the rig computing resource environment 105 may include control processes 143 that may use the sensor data 146 to optimize drilling operations, such as, for example, the control of drilling equipment to improve drilling efficiency, equipment reliability, and the like. For example, in some embodiments the acquired sensor data may be used to derive a noise cancellation scheme to improve electromagnetic and mud pulse telemetry signal processing. The control processes 143 may be implemented via, for example, a control algorithm, a computer program, firmware, or other suitable hardware and/or software. In some embodiments, the remote computing resource environment 106 may include a control process 145 that may be provided to the rig computing resource environment 105.

The rig computing resource environment 105 may include various computing resources, such as, for example, a single computer or multiple computers. In some embodiments, the rig computing resource environment 105 may include a virtual computer system and a virtual database or other virtual structure for collected data. The virtual computer system and virtual database may include one or more resource interfaces (e.g., web interfaces) that enable the submission of application programming interface (API) calls to the various resources through a request. In addition, each of the resources may include one or more resource interfaces that enable the resources to access each other (e.g., to enable a virtual computer system of the computing resource environment to store data in or retrieve data from the database or other structure for collected data).

The virtual computer system may include a collection of computing resources configured to instantiate virtual machine instances. The virtual computing system and/or computers may provide a human-machine interface through which a user may interface with the virtual computer system via the offsite user device or, in some embodiments, the onsite user device. In some embodiments, other computer systems or computer system services may be utilized in the rig computing resource environment 105, such as a computer system or computer system service that provisions computing resources on dedicated or shared computers/servers and/or other physical devices. In some embodiments, the rig computing resource environment 105 may include a single server (in a discrete hardware component or as a virtual server) or multiple servers (e.g., web servers, application servers, or other servers). The servers may be, for example, computers arranged in any physical and/or virtual configuration.

In some embodiments, the rig computing resource environment 105 may include a database that may be a collection of computing resources that run one or more data collections. Such data collections may be operated and managed by utilizing API calls. The data collections, such as sensor data, may be made available to other resources in the rig computing resource environment or to user devices (e.g., onsite user device 118 and/or offsite user device 120) accessing the rig computing resource environment 105. In some embodiments, the remote computing resource environment 106 may include similar computing resources to those described above, such as a single computer or multiple computers (in discrete hardware components or virtual computer systems).

In general, embodiments of the present disclosure may provide an instrumented slips assembly and method of using such a slips assembly. The slips assembly may include slips received into a slip base. The slips may be movable with respect to the base so as to engage and support a drill string. Further, the slips assembly may include sensors configured to measure the stress in or near the slips, thereby permitting a determination of the weight of the drill string, as experienced by the slips assembly. The sensors may monitor the displacement of drill string to determine whether the drill string moves when it is in the slips. Further, the slip sensors may provide the slip status to a rig controller for drilling optimization and automation.

Figure 3:
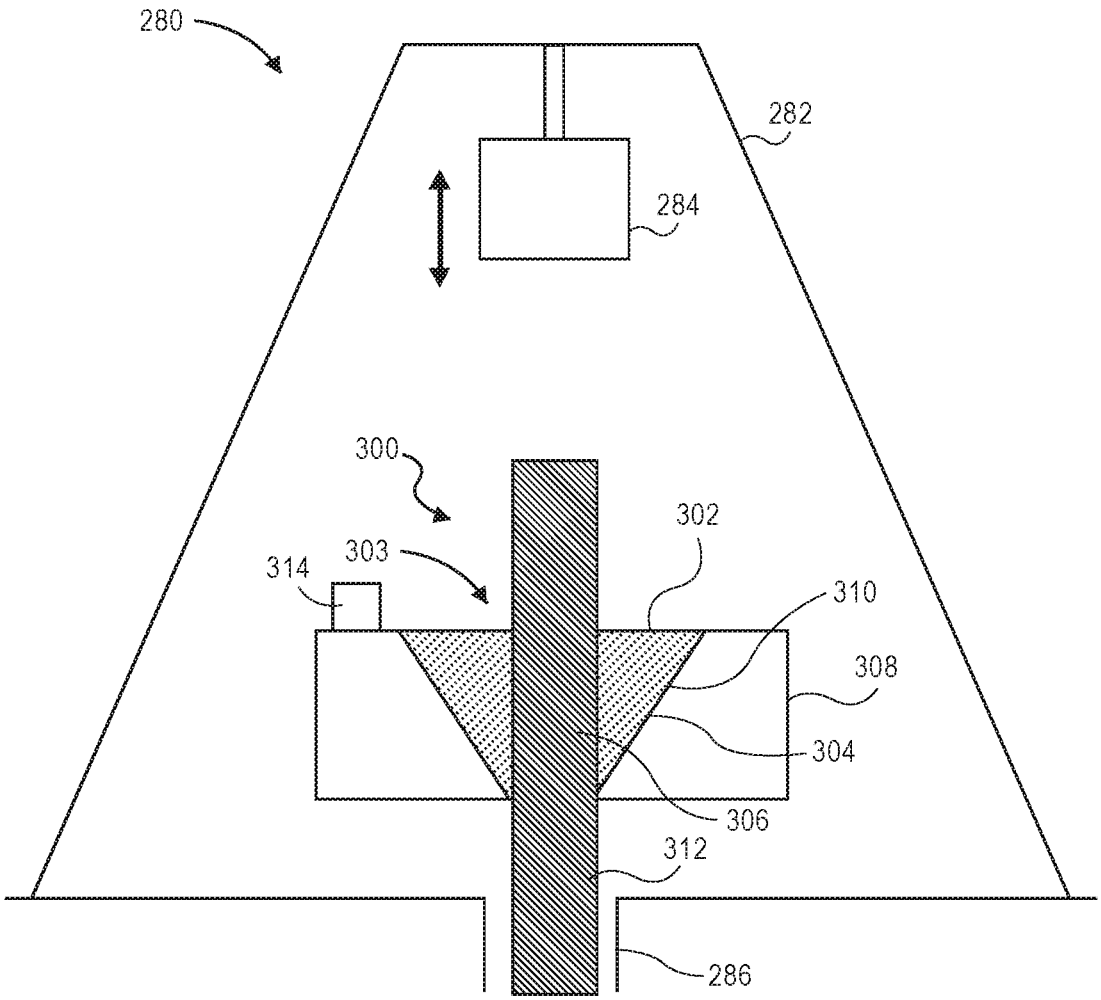
FIG. 3 illustrates a conceptual, side, schematic view of a drilling rig including a slip assembly, according to an embodiment.

FIG. 3 illustrates a simplified, schematic view of a drilling rig 280 including a slips assembly 300, according to an embodiment. It is emphasized that this simplified schematic view is not to scale. The drilling rig 280 may also include a rig structure 282, such as a derrick, as well as a first device 284. The first device 284 may be a top drive, which may be suspended from the rig structure 282 via a travelling block, crown block, etc., and may be movable vertically with respect to the rig structure 282 using a drawworks. The first device 284, in other embodiments, may be any other type of tubular hoisting, lowering, and/or rotating device. In the illustrated embodiment, the first device 284 may be capable of handling a tubular 312 (e.g., a drill pipe of a drill string), which may be lowered thereby (and/or rotated thereby) into a wellbore 286 extending into the earth.

The slips assembly 300 generally includes a plurality of slips 302 (two are shown as an example), which may be wedge-shaped, having a tapered outer surface 304 and a generally straight, in an axial direction, inner surface 306. The slips 302 may be arcuate segments, which together extend generally 360° in a circle, defining a central opening 303 through the slips assembly 300 for receiving the tubular 312. In some embodiments, the slips 302 may be rectilinear on at least one side (e.g., the inner surface 306), and may thus define a non-circular central opening 303.

The slips 302 may be received into a slip body 308 that may define a tapered inner surface 310. The slip body 308 (and the inner surface 310) may extend around the slips 302. In particular, the outer surface 304 of the slips 302 may be configured to slide axially and radially with respect to the tapered inner surface 310 (sometimes referred to as a "bowl"). In other embodiments, as will be described below, the slips 302 may be extendable and retractable radially, rather than received against the inner surface 310.

In addition, one or more sensors 314 may be positioned in or near the slip 302 to detect movement in the tubular 312, e.g., to determine whether or not the tubular 312 is "in slip," that is, supported by the slips 302. The sensor 314 may, for example, include an encoder which may be attached in proximity to the tubular 312, or a camera may be attached near the slip 302. Coupled with the slip status (in-slip, out-of-slip), an alarm can be raised (or another remedial action taken) when the tubular 312 is nominally in-slip and relative movement detected between the tubular 312 and the rig structure 282 (or the slip 302).

Figure 4:
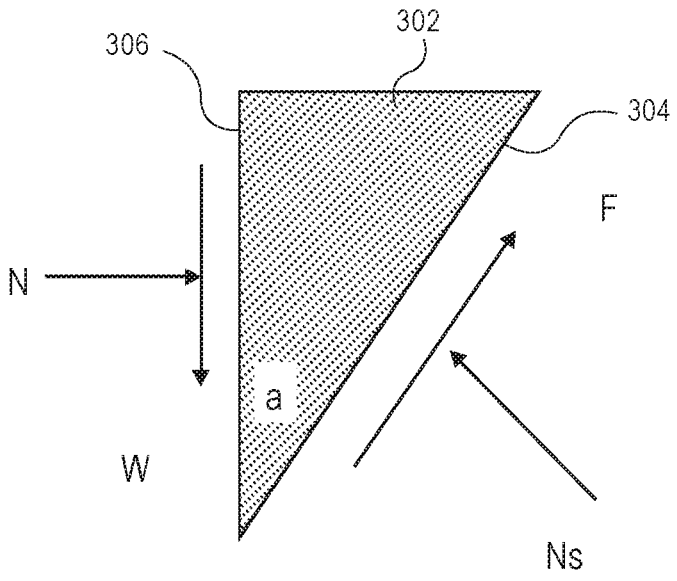
FIG. 4 illustrates a free body diagram of a slip, showing the incident forces thereon, according to an embodiment.

In an embodiment, the slips 302 may slide downward and inward along the inner surface 310 in order to engage and grip the tubular 312. With continuing reference to FIG. 3, FIG. 4 illustrates a free-body diagram of the forces incident on the slips 302 when engaging the tubular 312, e.g., when the slips 302 are set. As shown, the force N represents a normal contact force (i.e., gripping force) between slips 302 and the tubular 312. The force W is the weight of the tubular 312, as it is deployed into the wellbore 286. The force Ns represents normal contact force between the slip 302 and the slip body 308 on the rig structure 282 (e.g., the rig floor). The force F represents friction force between the slips 302 and the slip body 308, in an embodiment in which the slips 302 slide against the slip body 308. Measurements of one or a plurality of these forces (N, W, F, Ns, etc.) may be used to infer the weight of the drill string carried the slips when drill string is in slips.

As will be appreciated from this diagram, the weight of the tubular 312 is transmitted to the slip body 308 via the normal force Ns. In turn, the weight drives the slips 302 downward, and into tighter engagement with the tubular 312, i.e., increasing the normal force N. More concisely, the force balance leads to the following equations $$W=Ns*\sin(a)+F*\cos(a)$$

$$N=Ns*\cos(a)-F*\sin(a)$$

Figure 5:
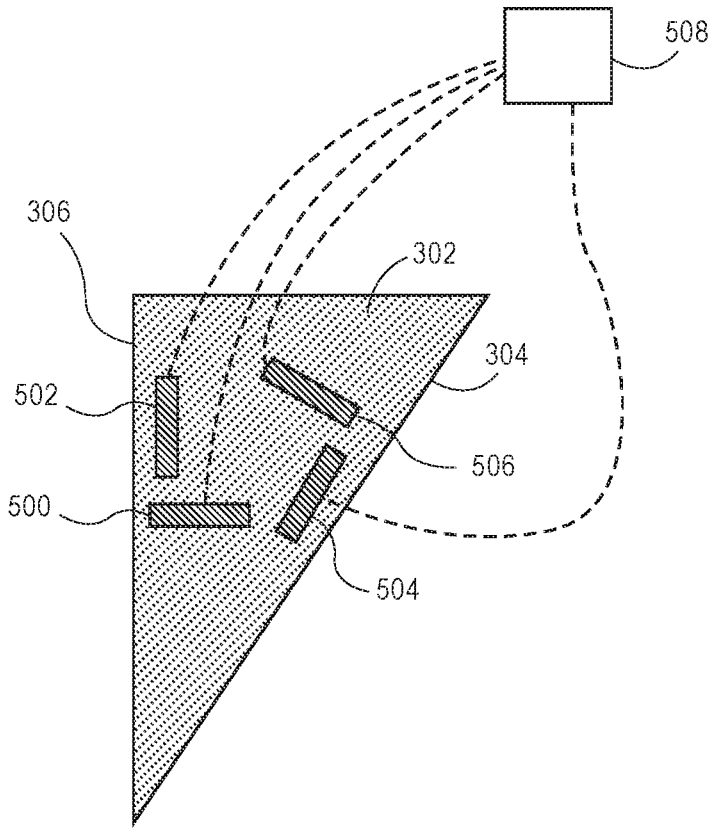
FIG. 5 illustrates a conceptual, side, schematic view of a plurality of sensors of the slip, according to an embodiment.

The presence of these forces in the slip (W, N, F, Ns) presents several options for measuring stress in the slips 302. FIG. 5 illustrates a schematic view of the slips 302, according to an embodiment. In particular, FIG. 5 illustrates several sensors 500, 502, 504, 506 that may be provided in the slips 302. The sensors 500, 502, 504, 506 may be load cells, strain gauges, or any other type of sensor, such as a sensor configured to measure a stress, strain or force. For example, the sensor 500 may measure the compressive contact force primarily contributed by the force N. Further, the sensor 502 may be configured to measure the friction force primarily contributed by the force W. The sensor 504 may be configured to measure the friction force primarily contributed by the force F. And the sensor 506 may be configured to measure the compressive contact force primarily contributed by the force Ns. It will be appreciated that any combination of one, two, three, four (or more) such sensors may be provided in various embodiments.

To place such sensors 500, 502, 504, 506 in the slips 302, holes may be drilled or otherwise cavities may be formed in the slips 302. In a specific embodiment, the sensor 500 may be placed in the slips 302 so as to extend from the inner surface 306, generally perpendicular thereto. The sensor 502 may extend generally parallel to the inner surface 306, e.g., in proximity thereto. The sensor 504 may be placed in proximity to the outer surface 304, and may extend generally parallel thereto. The sensor 506 may extend from the outer surface 304, generally perpendicular thereto.

The sensors 500, 502, 504, 506 may communicate with a controller 508, which may be or include one or more processors that provide a centralized acquisition system for the data collected by the sensors 500, 502, 504, 506 (and others, as will be described below), and may be part of or configured to communicate with the rig control system 100. The sensors 500, 502, 504, 506 may communicate wirelessly with the controller 508, as shown, or via wires, etc.

Figure 6:
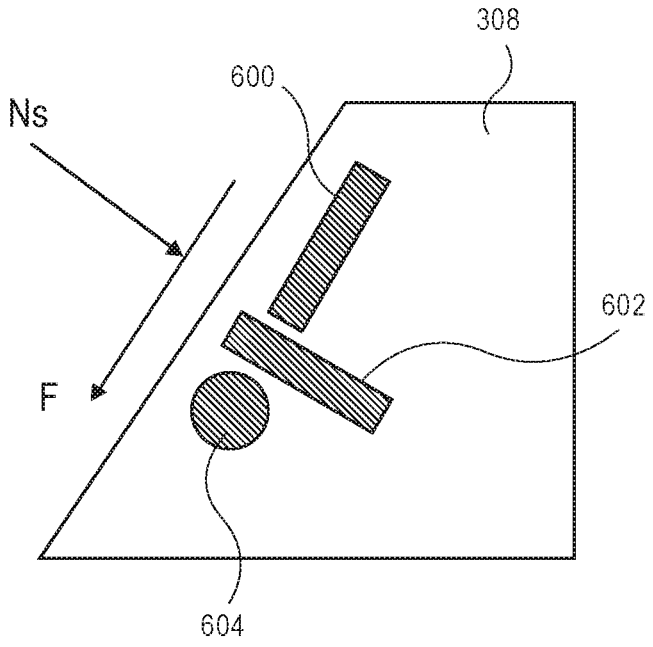
FIG. 6 illustrates a conceptual, side, schematic view of a plurality of sensors of the slip base, according to an embodiment.

The slip body 308 may additionally or instead be instrumented so as to measure forces incident thereon as part of supporting the slips 302, which in turn support the tubular 312. FIG. 6 illustrates a simplified, schematic view of the slip body 308 including a plurality of sensors 600, 602, 604 configured to detect stress in the slip body 308, according to an embodiment. The inner surface 310 of the slip body 308, opposite to the slips 302, experiences an equal and opposite force F and Ns, as shown. Accordingly, in an embodiment, the sensor 600 may measure the stress primarily contributed by the force F. The sensor 602 may measure the stress primarily contributed by the force Ns. The sensor 604 may measure the hoop stress primarily contributed by the force Ns. It will be appreciated that any combination of one, two, three (or more) such sensors may be provided in various embodiments.

Figure 7:
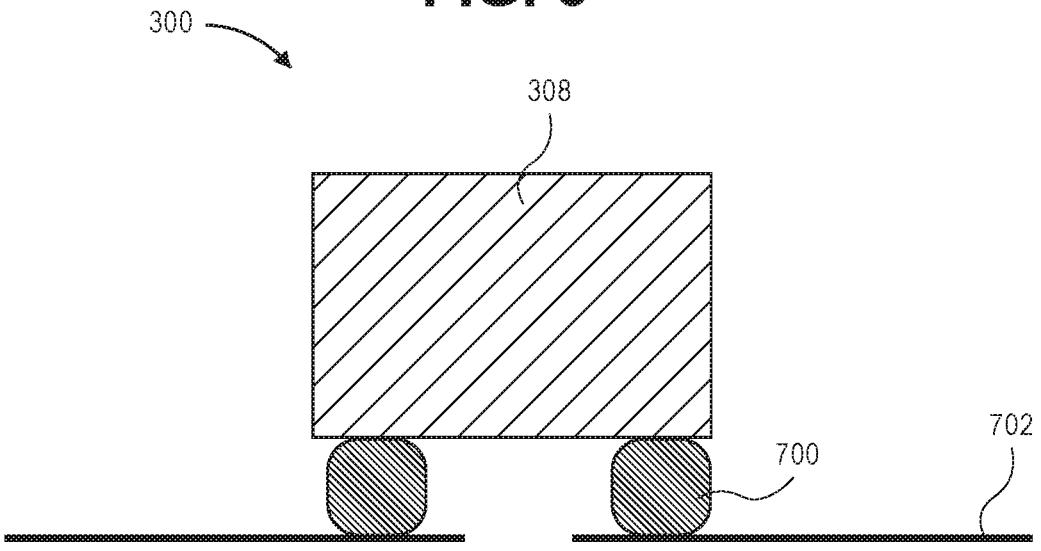
FIG. 7 illustrates a conceptual, side, schematic view of a sensor between the base and the rig structure (e.g., between the power slip and the rig structure), according to an embodiment.

In another embodiment, as shown schematically in FIG. 7, the slip assembly 300 may be a power slips, such that the slips 302 and the slip body 308 are provided as an integrated structure. In such an embodiment, one or more sensors 700, such as load cells, may be placed between the slip assembly 300, and a rig structure 702, such as the rig floor, rotary table, etc., at one or more locations where the rig structure 702 supports the slips assembly 300. It will be appreciated that the one or more sensors 700 between the slips assembly 300 and the rig structure 702 may also be used in the embodiment of FIGS. 3-5, in which the slips 302 are provided separately from the slip body 308. In this way, the sensors 700 may measure the stress, strain or force contributed primarily by the force W, provided by the weight of the tubular 312.

The sensor data collected by the sensors described above with reference to FIGS. 5 and/or 6 may be acquired in the centralized drilling acquisition system (controller 508). In addition, the surface weight measurement (i.e., hookload) may also be acquired by the acquisition system 508 from one or more sensors in the first device 284 (FIG. 3). A clock in the controller 508, or imposed by an external clock such as a clock of the rig control system 100, may provide a uniform timestamp to the data received representing the hookload and the slip loading, which may provide a time alignment between the two sets of data. To further improve the measurement, the data may be calibrated. This calibration may correlate the measurement from each sensor to the actual hookload in a discrete manner, such that a direct correlation can be established between the measurement of the slip sensors (slip load) and the surface measurement of hookload.

Figure 8:
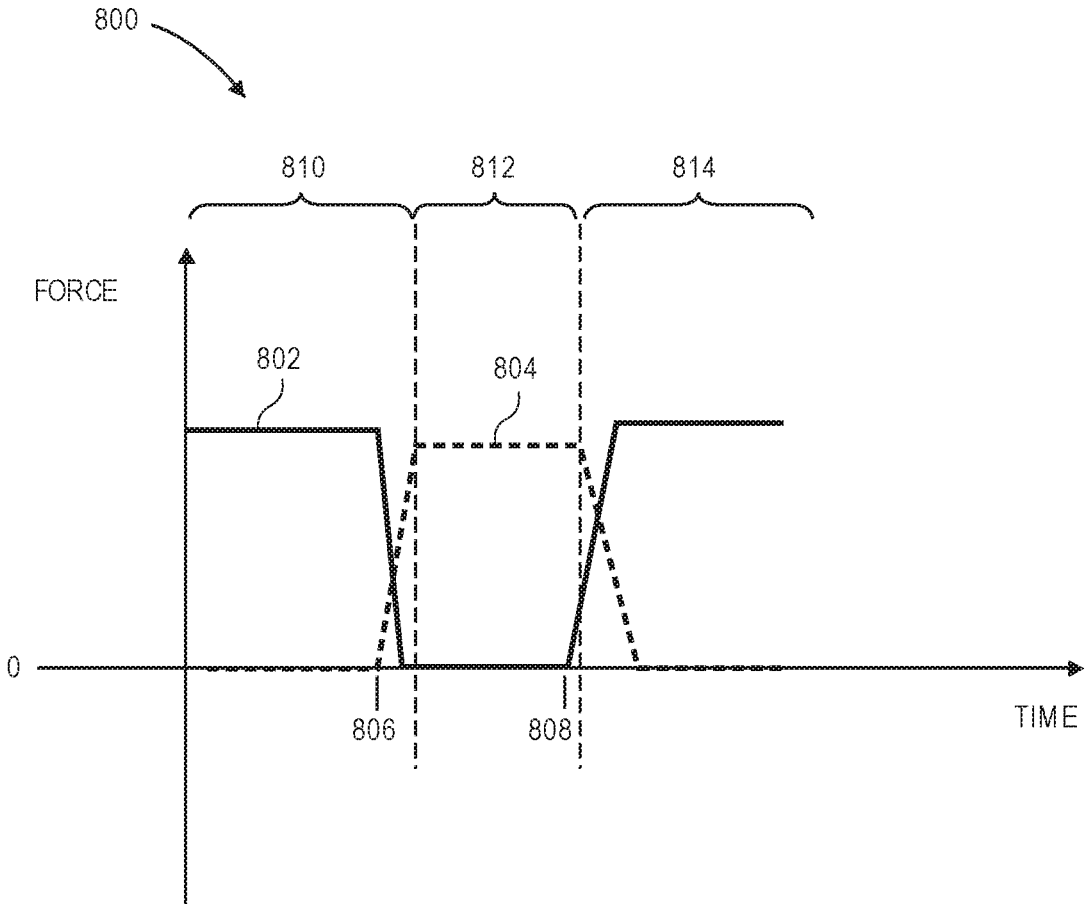
FIG. 8 illustrates a plot of hook load and sensor load versus time, according to an embodiment.

As such, a determination of in-slip status may be confirmed by monitoring the transition of weight between the hookload and slip load measurements. FIG. 8 provides an example of a plot 800 of transitioning between hookload 802 and slip load 804, according to an embodiment. In particular, hookload 802 and slip load 804 are plotted as a function of time. As shown, as the hookload 802 decreases at time 806, the slip load 804 increases. Conversely, as the hookload 802 increases at time 808, the slip load 804 correspondingly decreases. The hookload 802 when the tubular 312 is out of slip at 810 (before time 806), may be expected to approximately equal the hookload 802 plus the slip load 804 during a transition 812 (between time 806 and time 808), and may approximately equal the slip load 804 when the tubular 312 is in-slip (after time 808). If the loads during the transition 812 sum to a value less than the hookload 802 during 810, and/or if the slip load during 814 is less than the hookload 802 during 810, a slip condition (e.g., a kick in the wellbore or an incomplete support by the slips assembly 300) may be present. Furthermore, if the hookload 802 is not at zero after the slips assembly 300 is engaged, the slips 302 may not be fully engaged and may be prone to allowing the tubular 312 to move.

Figure 9:
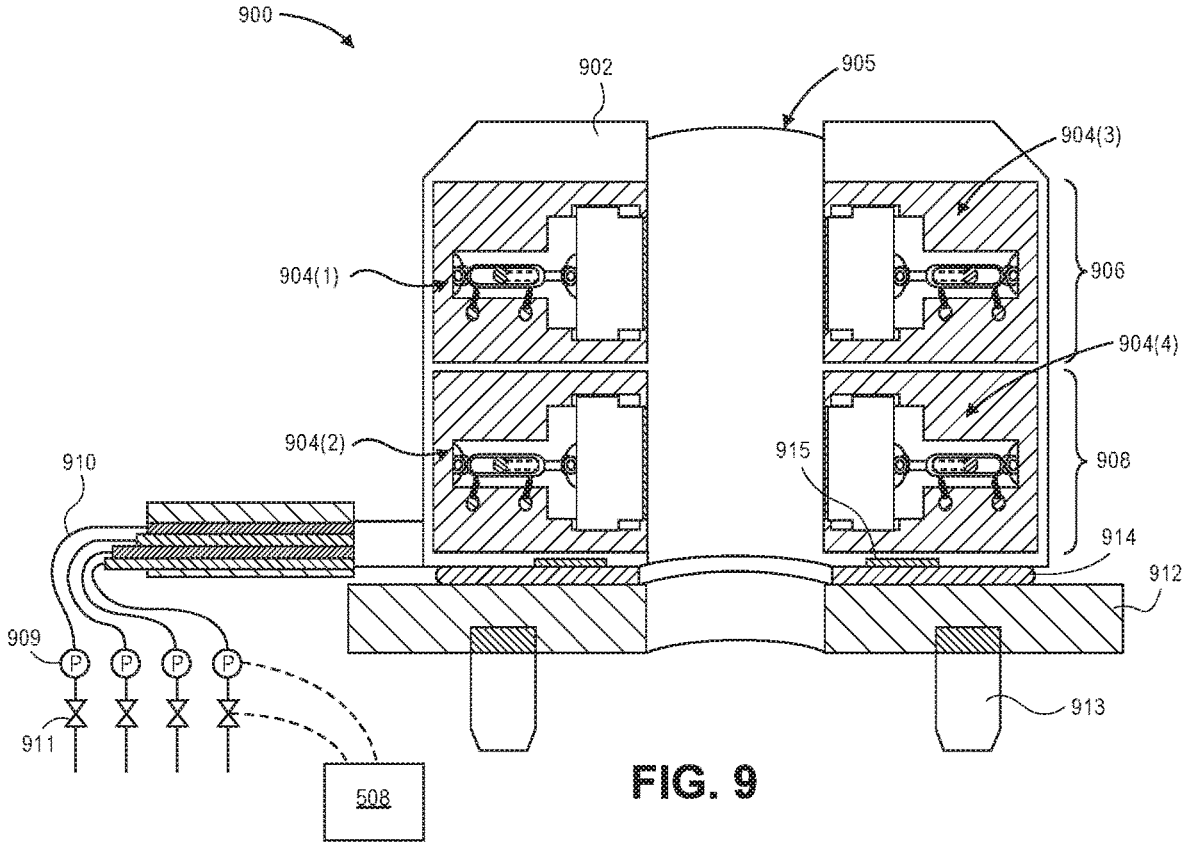
FIG. 9 illustrates a side, schematic view of a slips assembly in a retracted configuration, according to an embodiment.

FIG. 9 illustrates a side, schematic view of a cross-section of an instrumented slips assembly 900, according to an embodiment. The slips assembly 900 generally includes a body 902 in which a plurality of radially-movable slips (four are shown: 904(1), 904(2), 904(3), 904(4)) are positioned. The body 902 may be formed from two or more arc-shaped, hinged segments, or may be unitary in construction. Further, the body 902 may include a central opening 905, through which a tubular (e.g., drill pipe, casing, etc.) may be received. The slips 904(1)-(4) may be configured to grip the tubular, so as to support the weight thereof.

The slips 904(1)-(4) may be positioned in one or more rows (two shown: 906, 908), which may allow for the clamp referred to above to be omitted. When two or more rows of slips are provide, they are stacked one vertically above the other, thereby providing dual or multiple stage engagement of the tubular 312. Further, the slips 904(1)-(4) may be circumferentially offset from one another, as will be described below; however, in some embodiments, they may be circumferentially aligned, as shown in FIG. 9. Moreover, the slips 904(1)-(4) may be driven hydraulically, via hydraulic lines 910. In an embodiment, separate hydraulic lines 910 may be provided for the two vertical rows 906, 908, so as to allow for independent force adjustment of the slips 904(1), (3) and 904(2), 904(4) in the two rows 906, 908. In other embodiments, the slips 904(1)-(4) may each be independently controllable. In still other embodiments, the slips 904(1)-(4) may be controlled together by a single hydraulic circuit.

Flow through, and thus pressure in, the hydraulic lines 910 may be controlled via valves 911, e.g., one valve 911 for each line 910. In an embodiment, a pressure sensor 909 may be positioned in each line 910, upstream or downstream from the valve 911. The valves 911 may be actuatable in response to a signal from the controller 508; further, the controller 508 may be configured to receive a signal representing the pressure measured in each line by the sensors 909. In some embodiments, the valves 911 may be positioned within the slips 904(1)-(4), e.g., at the interface between the slips 904 and the associated hydraulic line 910. As such, the valves 911 may be variable control valves and may be configured to maintain a prescribed (as by the controller 508) hydraulic pressure within the slips 904, as the slips 904 engage the tubular.

The body 902, including the slips 904(1)-(4), may be positioned on a base 912. The base 912 may include two or more (e.g., four) pins 913, which may extend downward and may be received into holes of rotary table of the drilling rig 280, so as to be rotatable therewith. Between the base 912 and the body 902, an axial bearing 914 may be positioned. The bearing 914 may provide for relative rotation between the base 912 and the body 902, for example, to allow the base 912 on the rotary table to rotate, while the body 902 and the slips 904(1)-(4) therein remain stationary with respect to a tubular received therethrough.

Further, one or more sensors 915 may be positioned between the body 902 and the base 912. In various embodiments, the one or more sensors 915 may be positioned between the body 902 and the bearing 914, within the body 902 (e.g., toward the bottom thereof), between the bearing 914 and the base 912. The one or more sensors 915 may be load cells or other sensors configured to measure a weight supported by at least the slips assembly 900. This weight may include the weight of a tubular (e.g., drill string) supported by the slips assembly 900. The sensor(s) 915 may communicate a signal representing this weight to the controller 508.

Figure 10:
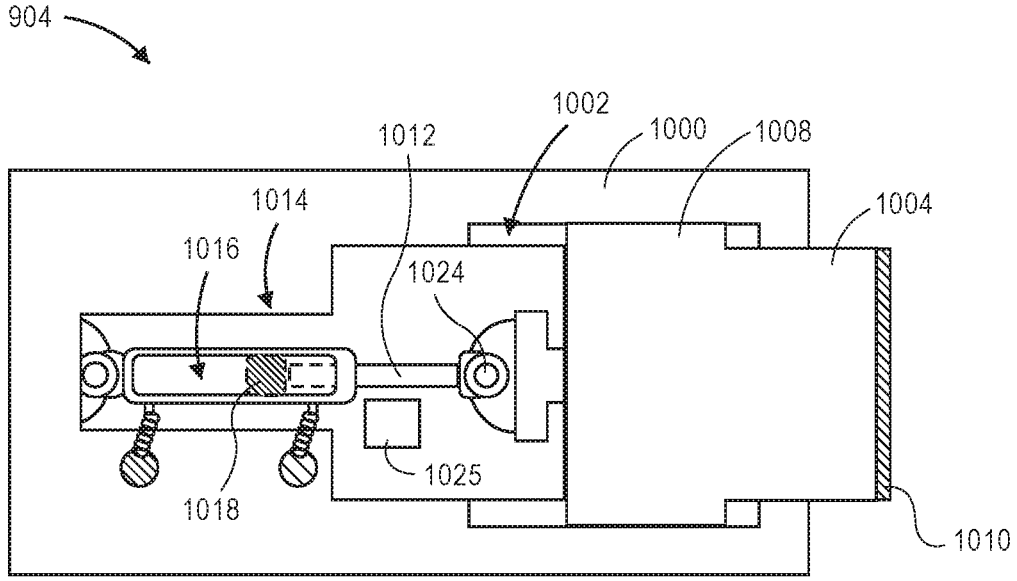
FIG. 10 illustrates an instrumented slip of the slips assembly of FIG. 9, according to an embodiment.

FIG. 10 illustrates an enlarged view of one of the slips 904(1)-(4), according to an embodiment. For ease of reference, this will simply be referred to as slip 904, and it will be appreciated that embodiments thereof may apply to any one or more of the slips 904(1)-(4).

The slip 904 may include a housing 1000 in which a chamber 1002 is defined. Within the chamber 1002, a block 1004 may be movably disposed such that movement of the block 1004 may translate into radial movement (toward or away from a tubular received in the central opening 905) when the slip 904 is assembled into the slips assembly 900 (FIG. 9). The block 1004 may have a smaller engaging section 1006 that is configured to move outward of the chamber 1002, and a larger retaining section 1008 that is too large to fit out of the chamber 1002, and is thus retained therein. A die 1010 may be attached to the engaging section 1006, so as to engage a tubular.

The slip 904 may also include a linkage 1012 and a piston 1014. The piston 1014 may be hydraulically driven in some embodiments, but may be pneumatically, mechanically, or electromechanically driven in other embodiments. In the specific, illustrated embodiment, the piston 1014 may include a piston head 1018 movably disposed in a piston chamber 1016. A first hydraulic line 1020 may be positioned on one side of the piston head 1018, and a second hydraulic line 1022 may be positioned on an opposite side of the piston head 1018. When pressure is supplied through the first hydraulic line 1020, the piston head 1018 may be driven in a first direction, and when pressure is supplied through the second hydraulic line 1022, the piston head 1018 may be driven in the opposite direction.

The movement of the piston head 1018 may be transmitted to the block 1004 via the linkage 1012, which may be connected to both. Movement of the piston head 1018 in the first direction may thus cause the block 1004 to move out of the housing 1000 and into engagement with a tubular, while movement of the piston head 1018 in the opposite direction may cause the block 1004 to be retracted into the housing 1000. Furthermore, an instrumented pin 1024 may be positioned in the linkage 1012, e.g., at the connection between the linkage 1012 and the block 1004. The instrumented pin 1024 may be configured to measure the force acting on the block 1004, as applied by the piston 1014. The pin 1024 may communicate a signal representing the force measured by the pin 1024 to the controller 508 (e.g., FIG. 9).

In addition, a sensor 1025 may be provided in the slip 904, and may be configured to determine a position of the block 1004. For example, the sensor 1025 may measure the distance between the piston 1014, or another fixed point of the housing 1000, and the block 1004. The sensor 1025 may be a linear variable differential transformer (LVDT), an optical (laser) sensor for gauging distance, an encoder, or any other suitable device. Further, the sensor 1025 may communicate the position to the controller 508 (e.g., FIG. 9). The position data may facilitate handling a plurality of differently-sized (in diameter) tubulars with a single slips assembly 900 and/or may be employed to determine the precise diameter of the tubular.

Figure 11A:
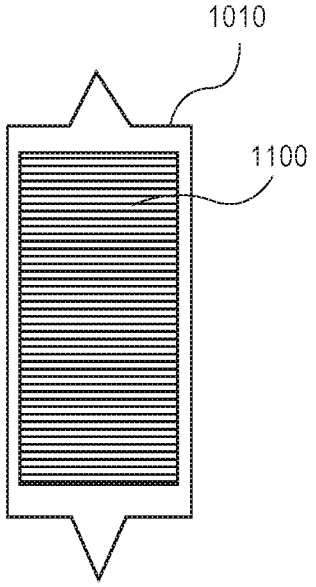
FIGS. 11A and 11B illustrate two gripping surfaces of the instrumented slips of the slip assembly, according to two embodiments.
Figure 11B:
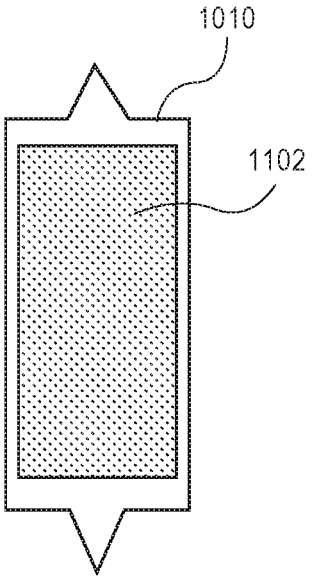

FIGS. 11A and 11B illustrate two examples of the die 1010, according to two embodiments. In the embodiment of FIG. 11A, the die 1010 includes a plurality of teeth 1100, which may be configured to bite into the tubular being gripped. In the embodiment of FIG. 11B, the die 1010 includes a high-friction gripping material 1102. The high-friction gripping material 1102 may be, for example, rubber, although any suitably high-friction material may be employed. An elastomeric material may be used for the high-friction material 1102 since it may be resiliently deformable, which may increase a surface area between the die 1010 and the tubular, thereby increasing friction forces generated by a given normal force.

Figure 12:
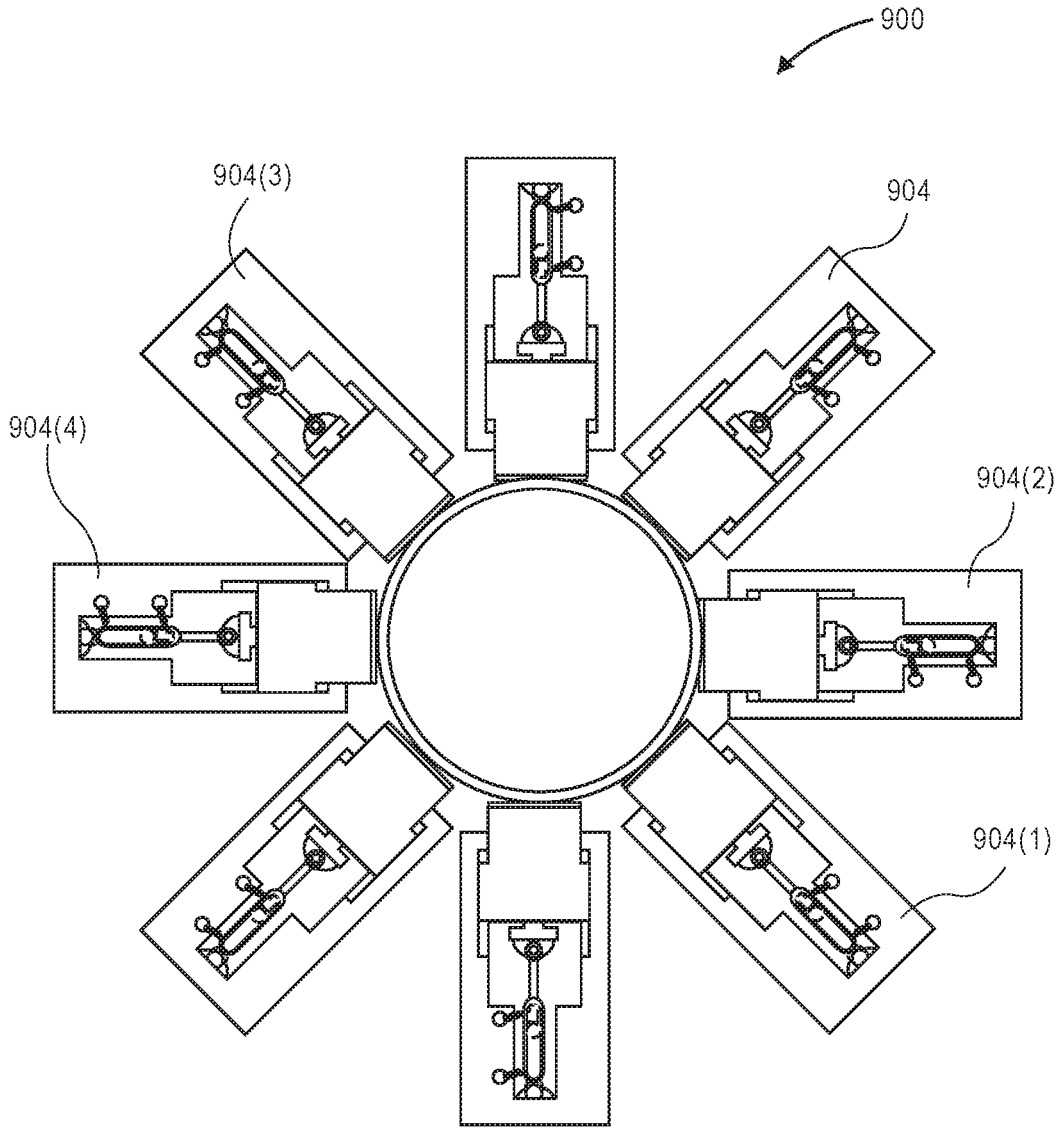
FIG. 12 illustrates a top, plan view of the slips assembly of FIGS. 10 and 12, according to an embodiment.

FIG. 12 illustrates a top, plan view of the slips assembly 900, according to an embodiment. It will be appreciated that this illustration is a simplified schematic view, with the base 912 and body 902 omitted in order to facilitate viewing the arrangement of the slips 904. As shown, eight slips 904 may be employed, although this number is merely one example among many possible. Further, alternating slips 904 may be in different rows 906, 908. For example, the slip 904(1) may be circumferentially adjacent to the slip 904(2), and likewise the slip 904(3) may be adjacent to the slip 904(4). Referring back to FIG. 9, the slips 904(1) and 904(3) may be in the upper row 906, while the slips 904(2) and 904(4) may be in the lower row 908.

Furthermore, as shown in FIG. 12, the block 1004 of each of the slips 904 is extended radially inward, such that the die 1010 thereof engages a tubular 1200 received through the central opening 905. When the die 1010 engages the tubular 1200, continued motion of the piston 1014 may result in a gripping force being applied via the block 1004 to the tubular 1200, and, accordingly, a reactionary force applied back through the block 1004 and the linkage 1012. Thus, the instrumented pin 1024 may measure this force, which may be used to determine when the slips 904 are engaging the tubular 1200 and/or to determine whether additional or less gripping force is called for, as will be described below.

Figure 13:
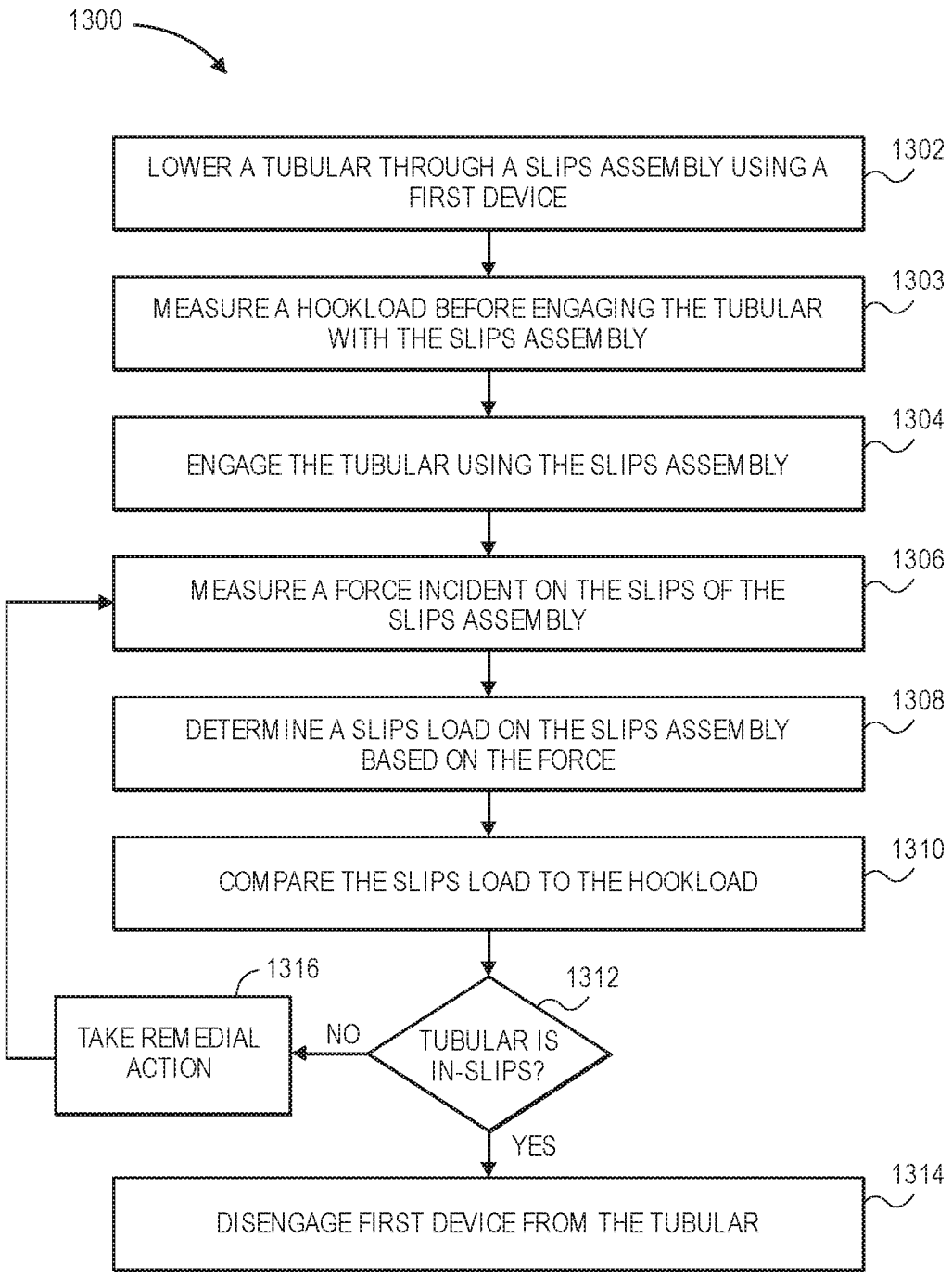
FIG. 13 illustrates a flowchart of a method for detecting a slip condition, according to an embodiment.

FIG. 13 illustrates a flowchart of a method 1300 for supporting a tubular, according to an embodiment. The method 1300 may proceed, in some embodiments, by operation of the slips assemblies 300, 900 according to one or more embodiments thereof. By way of example, the method 1300 is thus described with reference to these assemblies 300, 900. In other embodiments, the method 1300 may proceed by operation of any other suitable structure or device.

The method 1300 may begin by lowering a tubular 312, such as a drill pipe of a drill string, through a central opening 303, 905 in the slips assembly 300, 900, as at 1302. The tubular 312 may be lowered by connection with the first device 284 (e.g., top drive), and may be, in some embodiments, rotated during such lowering. The slips assembly 300, 900 may be in a retracted configuration during the lowering at 302, such that the slips 302, 904 are spaced radially apart from the tubular 312, allowing the tubular 312 to be lowered unimpeded by the slips assembly 300, 900.

The method 1300 may include measuring a hookload, as at 1303, before, during, or after lowering the tubular 312, at 1302, while the tubular 312 is supported by the first device and before engaging the tubular 312 with the slips assembly 300, 900. For example, the hookload may be measured using one or more sensors in the top drive, travelling block, drawworks, or another device configured to support and lower the tubular 312.

The method 1300 may also include engaging the tubular 312 in the slips assembly 300, 900 by moving the slips 302 (e.g., extending the block 1004 of the slips 904) radially inwards, as at 1304, e.g., after lowering the tubular 312 at 1302. This may occur manually, such as by pulling a lever or handle to slide the slips 302 downward with respect to the body 308, thereby moving the slips 302 radially inward. This may also or instead occur with the aid of hydraulics, e.g., in the slips assembly 900, or by using pneumatics, mechanical or electromechanical assemblies, etc.

The method 1300 may further include measuring a force incident on the slips 302, 904 as at 1306. Such a force measurement may be direct, e.g., using sensors embedded in the slips 302, such as one or more of the sensors 500, 502, 504, 506 illustrated in FIG. 5. In another embodiment, the force may be measured indirectly, such as in the body 308 using one or more of the sensors 600, 602, 604 embedded therein, or via the instrumented pin 1024 in the linkage 1012, hydraulic pressure in the piston 1014, etc. In yet another embodiment, the force may be measured as between the body 308, 902 and the rig structure 702 or base 912.

The slips assemblies 300, 900 may include or communicate with the controller 508 in order to engage the tubular 312 with a predetermined level of force. For example, the force incident on the slips 904 may be measured by the pin 1024. When this force is zero or otherwise low, the controller 508 may determine that the block 1004 is not engaged with the tubular 312. The controller 508 may thus increase hydraulic pressure (e.g., in the first hydraulic line 1020) in the piston 1014, thereby moving the block 1004 radially inward via the linkage 1012. When the block 1004 contacts the tubular 312 (e.g., via the die 1010), the force measured at the pin 1024 may increase abruptly, and may continue to increase as hydraulic pressure in the piston 1014 continues to increase. The controller 508 may have a predetermined setpoint of gripping force, and may determine, e.g., for each individual slip 904 or independently between the rows 906, 908, when the slips 904 are fully engaged when the force on the pin 1024 measures the predetermined gripping force.

The force incident on the slips 302, 904 or a change in the weight of the slips assembly 300, 900, e.g., as measured by the sensor 700 and/or 915 may allow a determination of the slips load, as at 1308. The slips load may be representative of a weight of the tubular 312 supported by the slips assembly 300.

In an embodiment, the method 1300 may also include comparing the slips load to the hookload, as at 1310. The method 1300 may then include determining whether the tubular 312 is "in-slips" in the slips assembly 300, 900 based on the comparison, as at 1312. For example, if the slips load is equal to the hookload measured before the slips 302, 904 engage the tubular 312, the tubular 312 may be in-slip, and the first device 284 (e.g., top drive) may be disengaged from the tubular 312, as at 1314, e.g., to begin running another tubular into the wellbore. If the slips load is less than the hookload, the tubular 312 may not be in-slip, but may be in a slipping condition (e.g., allowing the tubular 312 to move). The method 1300 may also include monitoring the slips load while the slips assembly 300, 900 is engaged in order to detect movement of the tubular 312 while the tubular 312 is nominally in-slip.

If the determination at 312 is that the tubular 312 is not fully in-slip, a remedial action may be taken, as at 1316, such as causing the slips 302, 904 to apply a larger gripping force on the tubular 312 (e.g., using hydraulics), waiting to release the top drive from the tubular (e.g., if the slipping condition is transient), or taking another action. In the slips assembly 900, for example, it may be apparent that the slips 904 in one of the rows 906, 908 are not fully engaging (e.g., the measured gripping force in the pin 1024 may be lower than expected), and thus the other row 906, 908 of slips 904 may be caused to grip the tubular 312 more tightly. Once the remedial action is complete, the method 1300 may include again measuring the force at 1306, but in other embodiments, may proceed directly to disengaging the first device at 1314.

Figure 14:
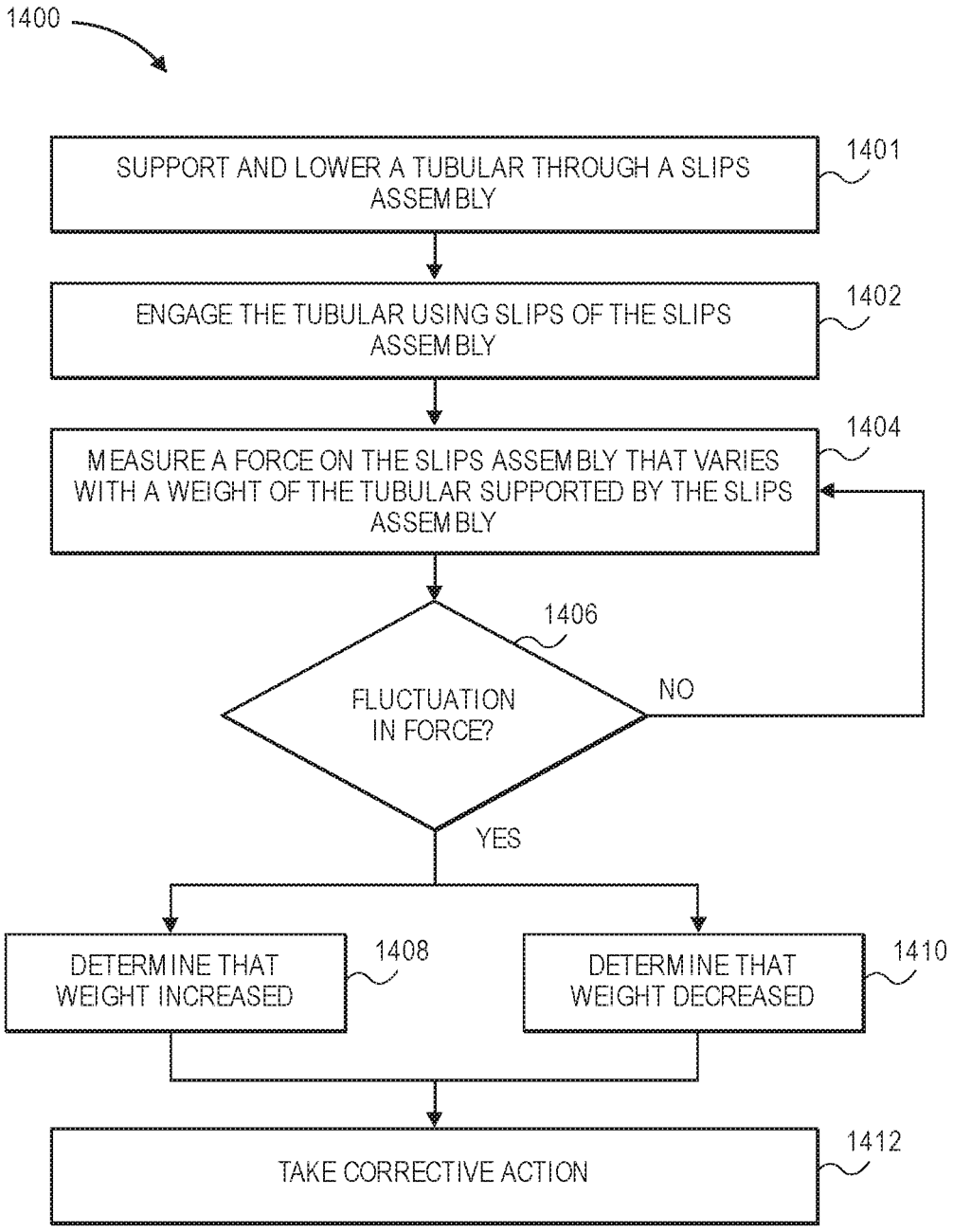
FIG. 14 illustrates a flowchart of a method for monitoring a well condition, according to an embodiment.

FIG. 14 illustrates a flowchart of a method 1400 for monitoring a well condition, according to an embodiment. Some embodiments of the method 1400 may be executed by operation of an embodiment of one of the slips assemblies 300, 900, and thus the illustrated embodiment of the method 1400 is described with reference thereto. However, it will be appreciated that the method 1400 may, in some embodiments, be executed using other structures.

The method 1400 may begin by supporting a tubular, such as a drill pipe of a drill string, using a top drive (or another tubular handling/drilling assembly), and lowering the tubular through a slips assembly 300, 900, as at 1401. After such lowering, the method 1400 may include engaging the tubular using slips 302, 904 of the slips assembly 300, 900, as at 1402, thereby securing the drill string in the slips assembly 300, 900.

The method 1400 may also include measuring a force on the slips assembly 300, 900 that fluctuates with the weight of the tubular (e.g., drill string) that is supported by the slips assembly 300, 900, as at 1404. For example, as described above, the force incident on the slips 302, 904 or the bowl (e.g., the inner surface 310), etc. may be measured, and from this, the supported string weight may be calculated. If the weight supported by the slips assembly 300, 900 varies (e.g. by pressure changes in the wellbore), this force incident on the slips 302, 904, and/or the slips body 308 may vary. In another example, the string weight may be more directly measured, e.g., using load cells measuring the effective weight of the slips assembly 300, 900, e.g., as between the slips body 308, 902, or elsewhere on the slips assembly 300, 900, and the rotary bushing or rig floor, etc.

Such measurement may be part of a systematic monitoring of the slips assembly 300, 900, and may be conducted to detect weight fluctuations experienced in the slips assembly 300, 900, as at 1406. For example, the method 1400 may then include determining that the weight has increased by an amount that is above a predetermined threshold, as at 1408. The threshold may be absolute (e.g., amount of weight above or below an average or expected value), in terms of percentage (i.e., a percentage fluctuation about an average or expected value), a combination thereof, or the like. Such an increased weight may be an indication that there is a loss of downhole pressure or fluids ("fluid loss").

The method 1400 may additionally include determining that the weight has decreased, as at 1410. Here again, this may be conducted by applying a threshold, in absolute (weight) terms and/or in percentage terms, in order to detect a weight decrease that is out of tolerance. Such a weight decrease may be an indication that there is an increase of downhole pressure or fluid ("well kicks"). In response to detecting either type of weight fluctuation, remedial actions (such as well control procedure) may be taken to secure the well, as at 1412. This may provide a safety warning to the operator.

Figure 15:
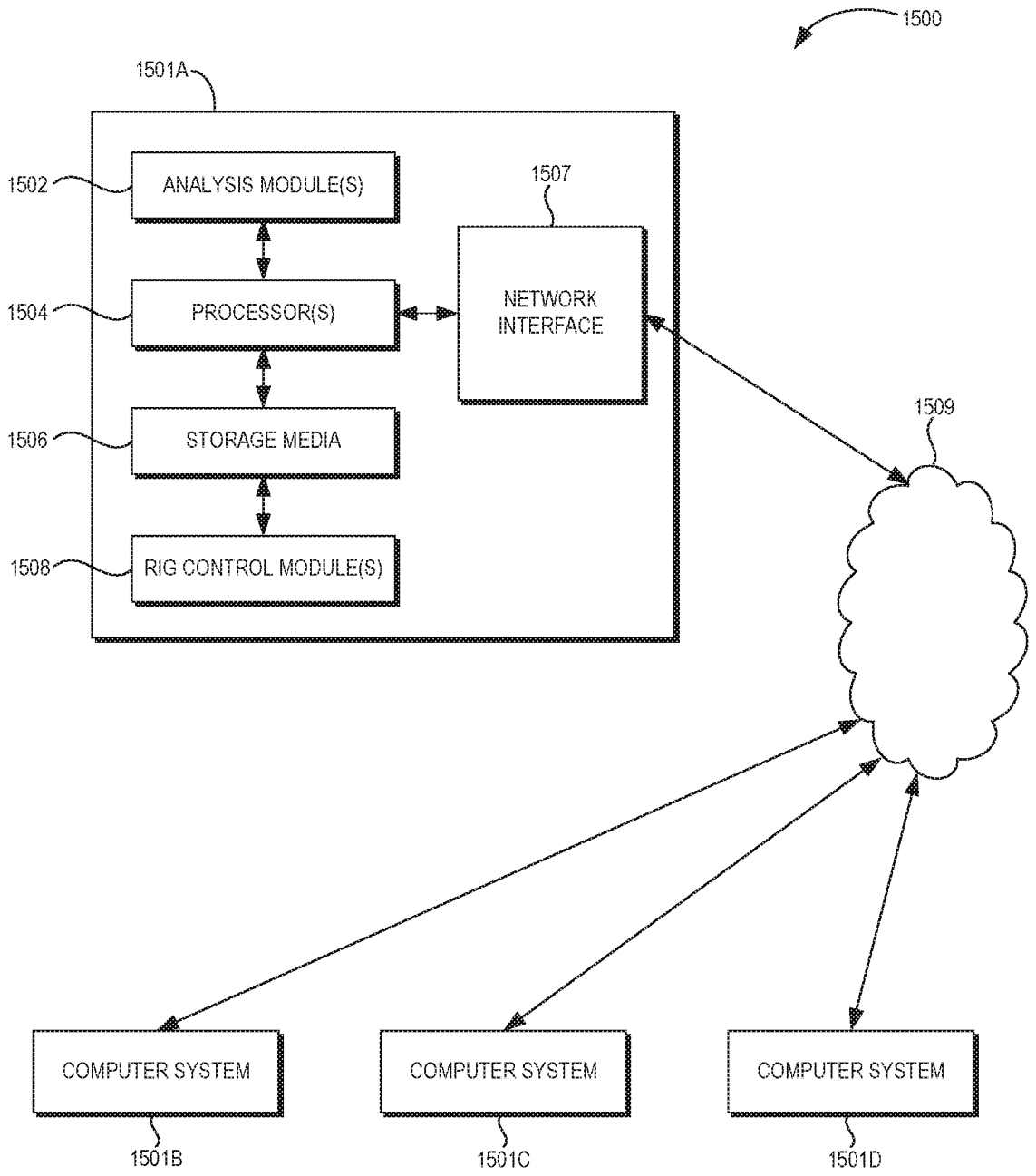
FIG. 15 illustrates a schematic view of a computing system, according to an embodiment.

In some embodiments, the methods of the present disclosure may be executed by a computing system. FIG. 15 illustrates an example of such a computing system 1500, in accordance with some embodiments. The computing system 1500 may include a computer or computer system 1501A, which may be an individual computer system 1501A or an arrangement of distributed computer systems. The computer system 1501A includes one or more analysis modules 1502 that are configured to perform various tasks according to some embodiments, such as one or more methods disclosed herein. To perform these various tasks, the analysis module 1502 executes independently, or in coordination with, one or more processors 1504, which is (or are) connected to one or more storage media 1506. The processor(s) 1504 is (or are) also connected to a network interface 1507 to allow the computer system 1501A to communicate over a data network 1509 with one or more additional computer systems and/or computing systems, such as 1501B, 1501C, and/or 1501D (note that computer systems 1501B, 1501C and/or 1501D may or may not share the same architecture as computer system 1501A, and may be located in different physical locations, e.g., computer systems 1501A and 1501B may be located in a processing facility, while in communication with one or more computer systems such as 1501C and/or 1501D that are located in one or more data centers, and/or located in varying countries on different continents).

A processor may include a microprocessor, microcontroller, processor module or subsystem, programmable integrated circuit, programmable gate array, or another control or computing device.

The storage media 1506 may be implemented as one or more computer-readable or machine-readable storage media. Note that while in the example embodiment of FIG. 15 storage media 1506 is depicted as within computer system 1501A, in some embodiments, storage media 1506 may be distributed within and/or across multiple internal and/or external enclosures of computing system 1501A and/or additional computing systems. Storage media 1506 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLURAY® disks, or other types of optical storage, or other types of storage devices. Note that the instructions discussed above may be provided on one computer-readable or machine-readable storage medium, or alternatively, may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, the computing system 1500 contains one or more rig control module(s) 1508. In the example of computing system 1500, computer system 1501A includes the rig control module 1508. In some embodiments, a single rig control module may be used to perform some or all aspects of one or more embodiments of the methods disclosed herein. In alternate embodiments, a plurality of rig control modules may be used to perform aspects of methods described herein.

It should be appreciated that computing system 1500 is only one example of a computing system, and that computing system 1500 may have more or fewer components than shown, may combine additional components not depicted in the example embodiment of FIG. 15, and/or computing system 1500 may have a different configuration or arrangement of the components depicted in FIG. 15. The various components shown in FIG. 15 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of protection of the invention.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to explain at least some of the principals of the disclosure and their practical applications, to thereby enable others skilled in the art to utilize the disclosed methods and systems and various embodiments with various modifications as are suited to the particular use contemplated.

What is claimed is:

1. A slips assembly comprising:

a body having a central opening; and a plurality of hydraulically driven slips positioned in the body and configured to cooperatively:

grip a tubular extending through the central opening, wherein the tubular is one of a plurality of tubulars connected end-to-end, and wherein the plurality of tubulars is a plurality of drill pipe tubulars or a plurality of casing tubulars; and support the weight of the plurality of tubulars;

wherein each slip comprises:

a housing having a first end, a second end further from the central opening than the first end, and an internal chamber extending through the first end; and a block radially movable within the internal chamber via hydraulic power and comprising:

a larger retaining section retained within the internal chamber; and a smaller engaging section configured to extend from the internal chamber into the central opening, via movement of the block within the internal chamber in a direction perpendicular to a longitudinal axis of the central opening, such that a die attached to the smaller engaging section engages the tubular.

2. The slips assembly of claim 1 wherein each slip comprises:

a piston head movably disposed in a piston chamber of the housing; and a linkage attached to the piston head and extending from the piston chamber into the internal chamber, wherein the linkage is also attached to the larger retaining section of the block within the internal chamber, such that hydraulically driven movement of the piston head within the piston chamber, in the direction perpendicular to the central opening axis, is imparted to the block via the linkage.

3. The slips assembly of claim 2 wherein, for each slip:

a first hydraulic line provides hydraulic fluid to the piston chamber on a first side of the piston head to move the piston head within the piston chamber in a first direction perpendicular to the central opening axis, thereby extending the smaller engaging section from the internal chamber so as to engage the tubular with the die; and a second hydraulic line provides hydraulic fluid to the piston chamber on a second side of the piston head to move the piston head within the piston chamber in a second direction opposite to the first direction, thereby retracting the smaller engaging section into the internal chamber so as to disengage the die from the tubular.

4. The slips assembly of claim 3 wherein, for each slip, an instrumented pin positioned at the attachment between the linkage and the block is configured for measuring a force applied by the piston and acting on the block.

5. The slips assembly of claim 1 wherein, for each slip, a sensor is configured to determine a position of the block within the internal chamber.

6. The slips assembly of claim 5 wherein the sensor is disposed within the internal chamber.

7. The slips assembly of claim 5 wherein the sensor is a linear variable differential transformer.

8. The slips assembly of claim 5 wherein the sensor is an optical sensor.

9. The slips assembly of claim 5 wherein the sensor is an encoder.

10. The slips assembly of claim 5 wherein the sensors of the slips collectively facilitate handling a plurality of different diameters of tubulars.

11. The slips assembly of claim 5 wherein the sensors of the slips collectively facilitate determining diameter of the tubular.

12. The slips assembly of claim 1 wherein the slips are positioned in two rows, including a first row stacked vertically above a second row.

13. The slips assembly of claim 12 wherein the slips in the first row are circumferentially offset from the slips in the second row.

14. The slips assembly of claim 12 wherein the slips in the first row are circumferentially aligned with the slips in the second row.

15. The slips assembly of claim 12 wherein the slips in the first row are hydraulically driven by hydraulic fluid from a first hydraulic line and the slips in the second row are hydraulically driven by hydraulic fluid from a second hydraulic line.

16. The slips assembly of claim 1 further comprising a plurality of hydraulic lines, and wherein the slips are each independently driven via hydraulic fluid from a different corresponding one of the hydraulic lines.

17. The slips assembly of claim 16 further comprising a plurality of valves each controlling flow through, and thus pressure in, a different corresponding one of the hydraulic lines.

18. The slips assembly of claim 17 further comprising a plurality of pressure sensors each sensing the hydraulic pressure in a different corresponding one of the hydraulic lines.

19. The slips assembly of claim 18 wherein each valve is actuatable in response to a signal from a controller based on signals transmitted to the controller by the pressure sensors representing the pressures in the hydraulic lines sensed by the sensors.

20. The slips assembly of claim 19 wherein the valves are variable control valves collectively configured to maintain a hydraulic pressure within the slips prescribed by the controller as the slips engage the tubular.

21. The slips assembly of claim 1 wherein the body comprises one or more sensors configured to measure weight of the plurality of tubulars supported by the slips.

22. The slips assembly of claim 1 wherein the body is positioned on a base comprising two or more pins extending into corresponding holes of a component of a drilling rig.

23. The slips assembly of claim 22 further comprising one or more sensors positioned between the body and the base and configured to measure weight of the plurality of tubulars supported by the slips.

24. The slips assembly of claim 22 wherein:

the drilling rig component is a rotary table that rotates relative to the drilling rig;

the pins extending from the base into the holes of the rotary table impart rotation of the rotary table to the base; and the slips assembly further comprises an axial bearing permitting relative rotation between the base and the body so that the body remains stationary with respect to the drilling rig and the tubular gripped by the slips while the base and the rotary table rotate relative to the drilling rig, the body, and the tubular gripped by the slips.

25. The slips assembly of claim 24 further comprising one or more sensors positioned between the body and the bearing and configured to measure weight of the plurality of tubulars supported by the slips.

26. The slips assembly of claim 24 further comprising one or more sensors positioned between the base and the bearing and configured to measure weight of the plurality of tubulars supported by the slips.

* * * * *